United States Patent [19]

van der Schoot

[11] 4,189,849

[45] Feb. 26, 1980

[54] METHOD AND APPARATUS FOR DRYING A ROLLER CONVEYOR LOADED WITH ARTICLES, SUCH AS EGGS, AND APPARATUS FOR WASHING, DRYING AND CANDLING EGGS LOADED ON A ROLLER CONVEYOR

[75] Inventor: Jelle van der Schoot, Aalten, Netherlands

[73] Assignee: Staalkat B.V., Aalten, Netherlands

[21] Appl. No.: 840,725

[22] Filed: Oct. 11, 1977

[51] Int. Cl.[2] ..... F26B 3/00

[52] U.S. Cl. ..... 34/33; 34/70; 34/217; 34/236

[58] Field of Search ..... 34/69–71, 34/95, 88, 216, 217, 236; 134/72

[56] References Cited

U.S. PATENT DOCUMENTS

| | | | |
|---|---|---|---|
| 1,327,486 | 1/1920 | McIntyre | 34/236 |
| 1,699,880 | 1/1929 | Cutler | 34/236 |
| 1,932,124 | 10/1933 | Tobey | 34/217 |
| 3,283,415 | 11/1966 | Schnyder | 34/95 |
| 3,525,160 | 8/1970 | Dokoupil et al. | 34/95 |

*Primary Examiner*—James C. Yeung

*Attorney, Agent, or Firm*—Cushman, Darby & Cushman

[57] ABSTRACT

A method of drying a roller conveyor which, loaded with articles, such as eggs, is passed through a washing apparatus, which drying comprises blowing air over and through the loaded conveyor, and wherein in at least one position in the transport range, part of the transporting section of the conveyor is temporarily withdrawn from the transport function, and is dried separately.

7 Claims, 4 Drawing Figures

METHOD AND APPARATUS FOR DRYING A ROLLER CONVEYOR LOADED WITH ARTICLES, SUCH AS EGGS, AND APPARATUS FOR WASHING, DRYING AND CANDLING EGGS LOADED ON A ROLLER CONVEYOR

The invention relates to a method of drying a roller conveyor which, loaded with articles, such as eggs, is passed through a washing apparatus, which drying comprises blowing air over and through the loaded conveyor.

In a like prior art method the complete drying of the conveyor consisting of rubber rollers, which take up a very great amount of moisture, and the eggs present thereon can only be effected by the supply of a very great amount of air.

It is the object of the invention to remove this drawback.

For this purpose the method is characterized in that in at least one position in the transport range, part of the transporting section of the conveyor is temporarily withdrawn from the transport function, and is dried separately. As a result there can be obtained with a comparatively small amount of energy a dry roller conveyor for the further transport of the eggs to the next station.

Furthermore the invention relates to an apparatus for performing this method, which apparatus comprises a roller conveyor and, arranged thereabove, an air blower box provided with one or more fans, while outside the transport range of the roller conveyor there is positioned a separate drying apparatus for the roller conveyor.

The drying apparatus equipped with a plurality of diversion gears may be arranged below the transport range of the roller conveyor, namely centrally situated below the air blower box, and be provided with a housing wherein are disposed centrally the drying means consisting of heat radiators, hot air or pressurized hot air. To the housing of the drying apparatus may be connected a discharge for moist air, so that it does not find its way into the working space.

Furthermore the invention relates to an apparatus for washing and candling eggs transported by means of a roller conveyor, which apparatus is provided with an air blower box arranged between a washing apparatus and a candling apparatus and above the endless roller conveyor, and, arranged therebelow, a drying apparatus for the roller conveyor provided with diversion rollers for the roller conveyor.

In illustration of the invention will now be described, with reference to the drawings, some embodiments of the drying apparatus arranged between a washing apparatus and a candling apparatus.

Figure 1:
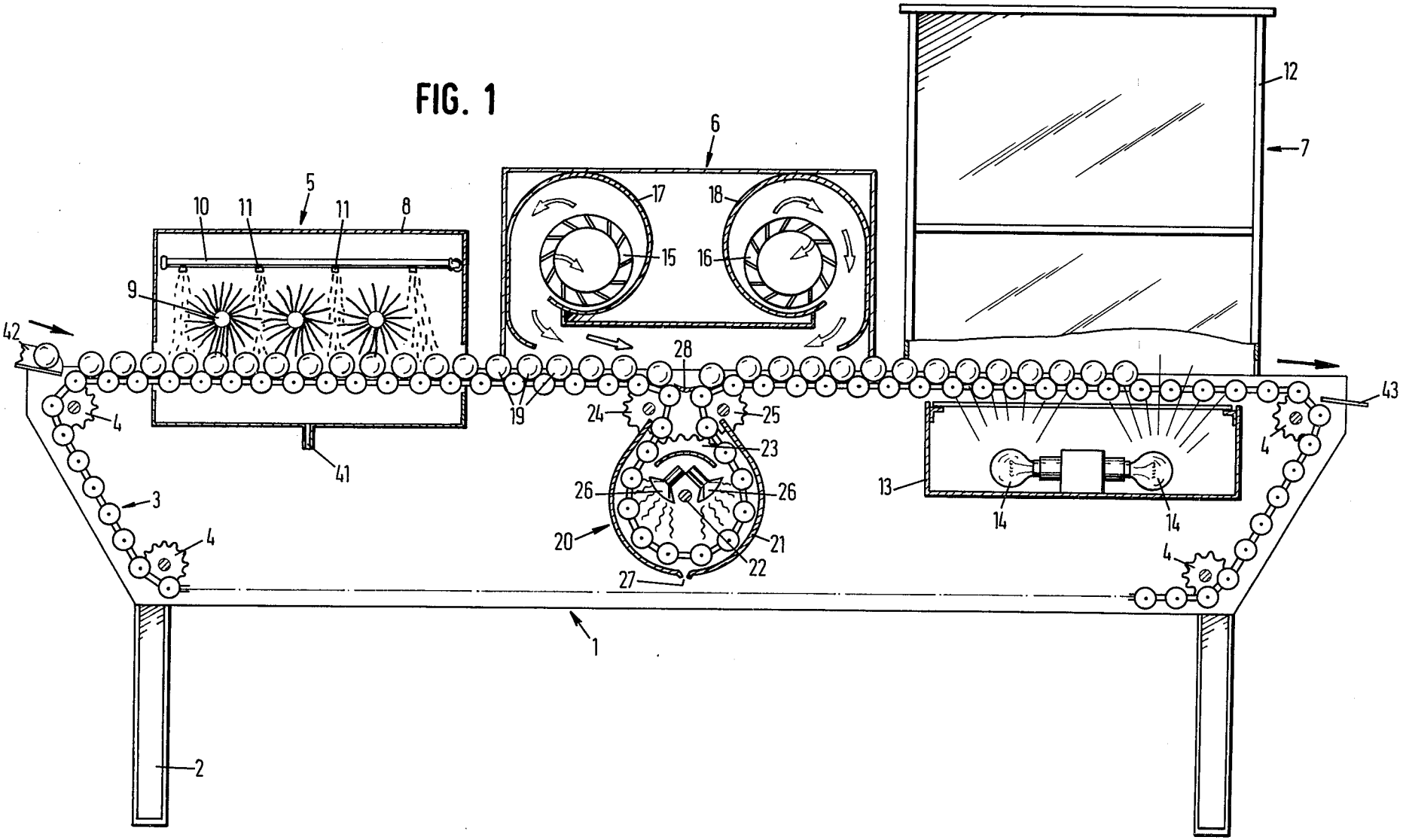
FIG. 1 is a longitudinal cross-section of an apparatus for washing, drying and candling eggs transported by means of a roller conveyor.
Figure 4:
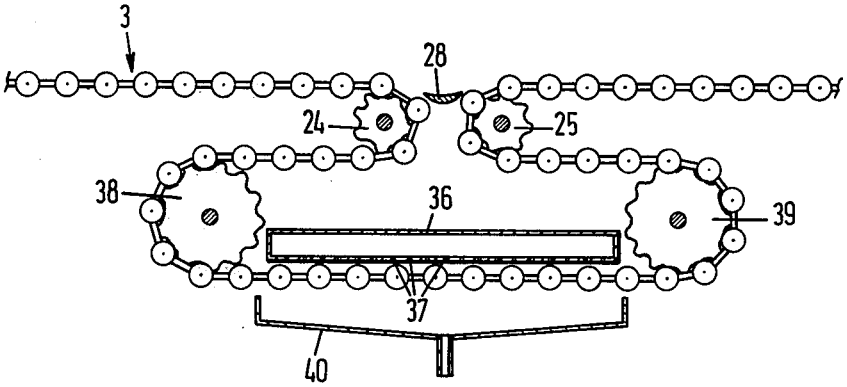

FIG. 4 very schematically shows a second variant of the drying apparatus used in the apparatus according to FIG. 1.

FIG. 1 shows an apparatus for washing, drying and candling eggs comprising a schematically drawn open container 1, which is supported by a frame 2. Inside the container there is arranged an endless roller conveyor 3, which is driven by means not shown, for the eggs to be treated 19, which roller conveyor is supported by a plurality of, in the embodiment shown four, support rollers 4. The eggs to be treated 19 are supplied via a supply trough 42 and discharged via a discharge trough 43.

Along the conveyor there are arranged in the direction of transport successively a washing apparatus 5, an air blower box 6 and a candling apparatus 7.

The schematically drawn washing apparatus 5 comprises a plurality of brushes 9 disposed inside a housing 8 and thereabove a plurality of sprinklers 11 connected to a water supply line 10. At the bottom side there is connected to the housing a discharge pipe 41 for discharging the washing water.

The schematically drawn candling apparatus 7 comprises a housing 12 disposed above the roller conveyor and, diametrically opposite, a light box 13 disposed below the roller conveyor and containing a plurality of, in the embodiment shown two, lamps 14 connected to power supply.

Between the washing apparatus 5 and the candling apparatus 7 there is arranged above the roller conveyor an air blower box 6 provided with two centrifugal fans 15 and 16, each accommodated in a volute 17 and 18, respectively. By means of these fans air is blown over and through the roller conveyor loaded with eggs 19 in the direction indicated by arrows.

Centrally situated below the air blower 6 there is arranged a drying apparatus 20 provided with a housing 21. Inside the housing there are arranged two or more diversion gear 23 mounted on a shaft 22, while on either side of the supply and discharge opening for the roller conveyor there are arranged pairs of reversal gears 24 and 25, respectively, for passing the roller conveyor through the drying apparatus. For the transfer of the eggs passed through the drying apparatus there is provided a guide plate 28.

Inside the housing 21 there are arranged between the diversion gears 23 a plurality of heat radiators 26 which supply the heat necessary for drying the roller conveyor, in particular the rollers thereof.

As appears from FIG. 1, at its bottom side the housing 21 is provided with a slit 27 destined for passing through leakage water, if any.

As was already stated above, when moving through the drying apparatus 20, the roller conveyor is dried completely. The moisture still present on each egg at the moment when the egg is separated from the roller conveyor will be distributed over the entire egg when it is rolled over the guide plate 28 and re-contacted with the roller conveyor, and can easily be removed by means of the air originating from the right-hand fan 16 in FIG. 1.

Figure 2:
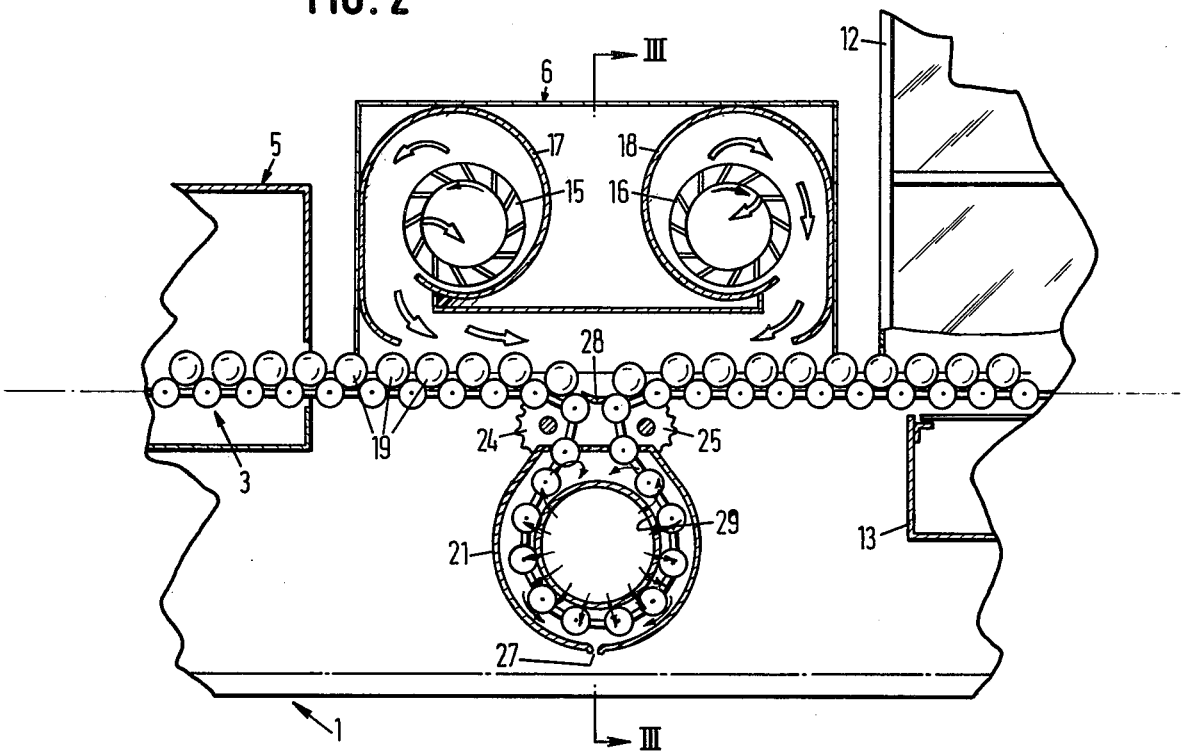
FIG. 2 shows a variant of the drying apparatus used in the apparatus according to FIG. 1.
Figure 3:
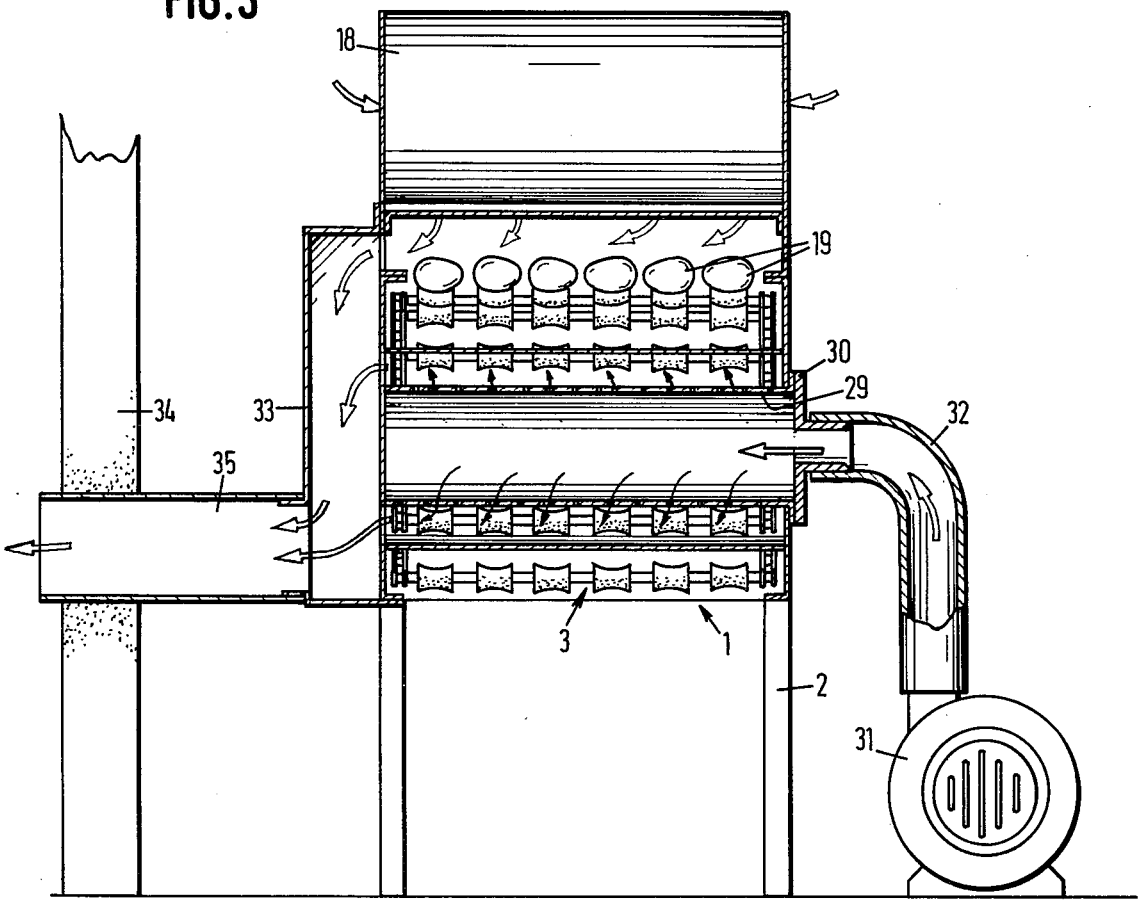
FIG. 3 is a cross-section on line III-III in FIG. 2.

The apparatus given in FIGS. 2 and 3 (wherein the same parts are indicated by the same reference numerals) essentially differs from the apparatus given in FIG. 1 only in that no use is made of heat radiators, but of air whether or not heated. For this purpose the drying apparatus 20 is provided with a hollow cylinder 29 comprising not further indicated outlet openings.

At the one end of the cylinder there is connected a supply stub 30, while the other end is closed. Air is supplied to the cylinder 29 from a fan 31 through a length of tubing 32 and the said supply stub 30.

As appears from FIG. 3, the air blower box 6 and the housing 21 of the drying apparatus 20 through not further indicated openings are in communication with an air outlet box 33, to which is connected an outlet tube 35 extending through an (outer) wall 34.

In FIG. 3 the entire air flow pattern through the apparatus has been indicated by means of arrows.

In the third embodiment shown in FIG. 4 there is used for the drying of the roller conveyor a high pressure box 36 provided with outlet openings 37, which box is fed with pressurized air in a manner not further indicated and is arranged between two pairs of diversion rollers 38 and 39, respectively, for guiding the roller conveyor.

Under the high pressure box and the part of the roller conveyor moving along thereunder there is arranged a drip tray 40 for discharging water originating from the roller conveyor.

Finally, it is observed that within the scope of the inventive idea a great number of modifications are possible.

I claim

1. In a method of transporting and drying articles supported on an endless conveyor, in which the conveyor and the articles pass through a liquid washing apparatus so that both the conveyor and the articles become wet, and in which drying air is then blown over the wet conveyor and the articles thereon in a drying stage, the improvement which comprises separating a length of the wet conveyor from the articles in the drying stage after partial drying of the articles and of the conveyor, further drying the wet length of the conveyor while separate from the articles, returning the length to the drying stage and reengaging the articles with the conveyor in the drying stage for further transport and drying of the articles.

2. A method as in claim 1 wherein the articles are eggs.

3. A method as in claim 1 including the step of redistributing liquid remaining on the articles separated from the wet length of conveyor over the surface of the articles before reengaging the articles with the dried conveyor.

4. A method as in claim 3 wherein the articles are eggs.

5. In apparatus for washing and drying articles: a liquid washing station; a first drying station including air blowing means; a second drying station; an endless conveyor movable through the washing station and into the first drying station for transporting the articles; means for separating the articles from a length of the conveyor in the first drying station, for diverting said length of the conveyor to said second drying station while retaining the articles in said first drying station, for returning said length from said second to said first drying stage and for reengaging the articles with the conveyor for further drying and transport through said first drying stage.

6. Apparatus as in claim 5 including means in said first drying station for redistributing over the surface of the articles liquid remaining on the articles after separation from said conveyor length.

7. Apparatus as in claim 5 wherein said conveyor is a roller conveyor, wherein said air blowing means in said first drying stage is arranged to blow air downwardly through said conveyor, and wherein said second drying stage is arranged below said first drying stage.

* * * * *